US009416640B2

(12) United States Patent
Parman et al.

(10) Patent No.: US 9,416,640 B2
(45) Date of Patent: Aug. 16, 2016

(54) DOWNHOLE WELLBORE HEATING SYSTEM AND METHOD

(71) Applicants: David G. Parman, San Ramos, CA (US); Kelly O'Brien, Houston, TX (US); Fardin Farzaneh, Sugar Land, TX (US)

(72) Inventors: David G. Parman, San Ramos, CA (US); Kelly O'Brien, Houston, TX (US); Fardin Farzaneh, Sugar Land, TX (US)

(73) Assignee: Pentair Thermal Management LLC, Menlo Park, CA (US)

( * ) Notice: Subject to any disclaimer, the term of this patent is extended or adjusted under 35 U.S.C. 154(b) by 509 days.

(21) Appl. No.: 14/033,072

(22) Filed: Sep. 20, 2013

(65) Prior Publication Data

US 2014/0099084 A1 Apr. 10, 2014

Related U.S. Application Data

(60) Provisional application No. 61/703,464, filed on Sep. 20, 2012.

(51) Int. Cl.

| | |
|---|---|
| ***E21B 7/15*** | (2006.01) |
| ***H05B 3/02*** | (2006.01) |
| ***E21B 43/24*** | (2006.01) |
| ***E21B 33/04*** | (2006.01) |
| ***E21B 17/10*** | (2006.01) |

(52) U.S. Cl.

CPC ..... *E21B 43/2401* (2013.01); *E21B 17/105* (2013.01); *E21B 33/0407* (2013.01)

(58) Field of Classification Search

None

See application file for complete search history.

(56) References Cited

U.S. PATENT DOCUMENTS

| | | | | |
|---|---|---|---|---|
| 1,169,262 | A * | 1/1916 | Huff | E21B 36/04 166/60 |
| 1,700,336 | A | 1/1929 | Redfield | |
| 3,713,482 | A | 1/1973 | Lichte, Jr. et al. | |
| 3,780,803 | A | 12/1973 | Hardy et al. | |
| 3,804,163 | A | 4/1974 | Bradley et al. | |
| 3,912,445 | A | 10/1975 | Seefluth | |
| 4,545,442 | A | 10/1985 | Warner et al. | |
| 5,070,533 | A | 12/1991 | Bridges et al. | |

(Continued)

FOREIGN PATENT DOCUMENTS

CA 2679994 A1 8/2008

*Primary Examiner* — Thor Campbell
(74) *Attorney, Agent, or Firm* — Quarles & Brady LLP

(57) ABSTRACT

Embodiments of the invention provide systems and methods for heating a wellbore environment. One or more electric heating cables are attached to an elongated support member, such as a wire rope, so that the support member receives and relieves the heating cables of a mechanical load. The attachment may be with two-piece clamps spaced at regular intervals along the support member. The heating cables and support member may be disposed in coiled tubing within the wellbore. The coiled tubing can be pressure-sealed and filled with a dielectric fluid. The heating cables and support member can be attached to a cable hang-off having a plurality of wedge-shaped slips that cooperate with a bowl to form a pinching member that grips the support member and suspends the support member and heating cables in the wellbore. The methods include methods for manufacturing and installing the heating apparatus.

20 Claims, 22 Drawing Sheets

(56) References Cited

U.S. PATENT DOCUMENTS

| | | | | |
|---|---|---|---|---|
| 5,252,808 | A * | 10/1993 | Morgan | B08B 9/08 126/343.5 A |
| 5,623,576 | A * | 4/1997 | Deans | E21B 36/04 166/60 |
| 6,250,371 | B1 | 6/2001 | Amerman et al. | |
| 6,276,438 | B1 | 8/2001 | Amerman et al. | |
| 6,360,819 | B1 | 3/2002 | Vinegar | |
| 6,585,036 | B2 | 7/2003 | Amerman et al. | |
| 6,672,371 | B1 | 1/2004 | Amerman et al. | |
| 6,896,063 | B2 | 5/2005 | Chang et al. | |
| 7,017,650 | B2 | 3/2006 | Johnson, Jr. et al. | |
| 7,051,811 | B2 | 5/2006 | de Rouffignac et al. | |
| 7,090,013 | B2 | 8/2006 | Wellington | |
| 7,367,399 | B2 | 5/2008 | Steele et al. | |
| 7,398,823 | B2 * | 7/2008 | Montgomery | E21B 36/04 166/248 |
| 7,730,936 | B2 | 6/2010 | Hernandez-Solis et al. | |
| 7,753,344 | B1 | 7/2010 | Moretz et al. | |
| 7,891,416 | B2 | 2/2011 | Pankratz et al. | |
| 8,087,460 | B2 | 1/2012 | Kaminsky | |
| 8,151,877 | B2 | 4/2012 | Kaminsky et al. | |
| 8,353,347 | B2 * | 1/2013 | Mason | E21B 43/2401 166/302 |
| 8,622,133 | B2 | 1/2014 | Kaminsky | |
| 2007/0133959 | A1 * | 6/2007 | Vinegar | C07C 4/02 392/301 |
| 2009/0260809 | A1 | 10/2009 | Wellington et al. | |
| 2011/0259580 | A1 | 10/2011 | Head | |
| 2012/0080419 | A1 | 4/2012 | Bush et al. | |

* cited by examiner

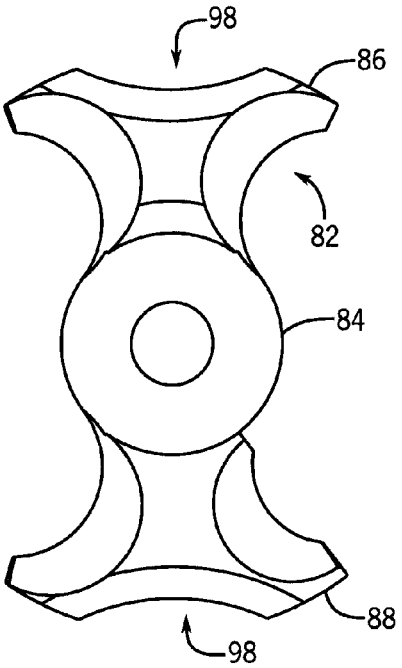
FIG. 14
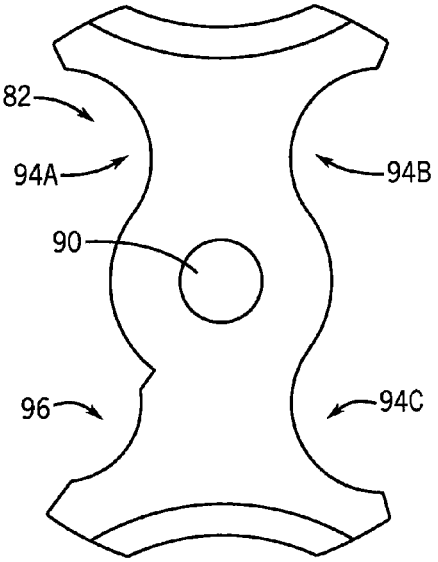
FIG. 15
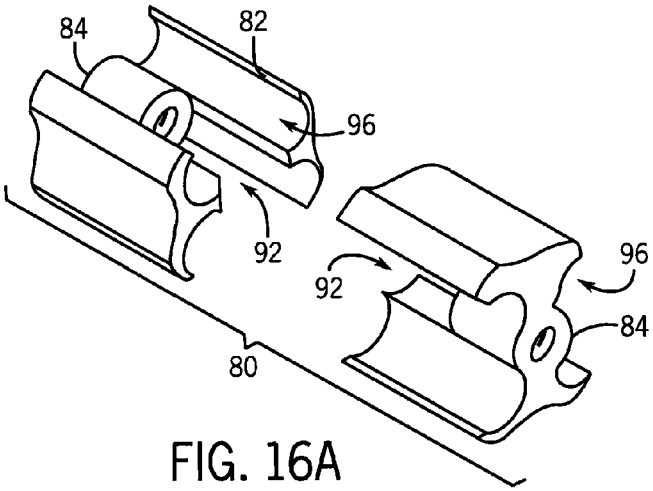
FIG. 16A
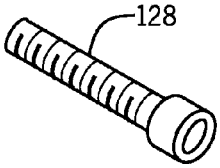

DOWNHOLE WELLBORE HEATING SYSTEM AND METHOD

RELATED APPLICATIONS

This application claims priority to U.S. Provisional Patent Application No. 61/703,464 filed on Sep. 20, 2012, the entire contents of which are incorporated herein by reference.

BACKGROUND

It is often beneficial to provide downhole heat in oil and/or gas wells and similar environments. For example, heat can be delivered to the production tubing in the well via a heater installation in order to heat the oil to be extracted, reducing its viscosity and improving extraction rates. In another example for heavy oil production, the heater installation can deliver heat to the oil reservoir itself to increase the amount of oil that enters the production tubing. Existing downhole heater installations typically require the use of a drilling or other rig. Further, the installation of a heater is usually managed by clamping heater cables to the exterior of the production tubing, which generally requires that a complete workover or similar operation must be performed. Such operations can be very time consuming and expensive processes.

In certain circumstances, heating systems of the present invention can be deployed within continuous tubing, frequently referred to as "coiled tubing" because it is sufficiently flexible to be coiled onto a spool and transported to the deployment site. Deployment of coiled tubing heaters improves heat transfer to a target medium because such coiled tubing heaters provide a larger surface area in contact with said medium, and can frequently be installed so as to be in direct contact with said medium. Further, because exposure of heater cables to well fluids can be problematic due to the chemical makeup of such fluids, installation of such heater cables within coiled tubing isolates and protects heater cables from such well fluids. In many applications, such continuous tubing heating devices can be installed without performing a workover, or requiring the use of a drilling or other rig.

Electric cables typically do not have sufficient tensile strength to be deployed independently within a tube, especially over relatively long vertical sections. Accordingly, various means of providing support to heater cables have been designed including, without limitation, for downhole skin-effect heaters like the skin-effect heating cable described in co-pending United States Patent Application Publication No. 2011/0233192, entitled "SKIN EFFECT HEATING SYSTEM HAVING IMPROVED HEAT TRANSFER AND WIRE SUPPORT CHARACTERISTICS", which is incorporated herein by reference. Unfortunately, such existing methods are generally not suitable to use with multiple independent cables, such as mineral insulated ("MI") cables, that comprise their own electrical circuit and do not need to be electrically attached to the coiled tubing to function.

In some cases, simple banding or clamping materials have been used to support cables in a desired position, including binding such cables to support rope. However, simple banding can come loose, particularly after thermal cycling of heating elements. Other methods of installing cables into tubes have been utilized in the oil and gas industry include: crimping the tube to the cables; using helical buckling to self support the cables; using high strength conductor materials; and tightly forming the tube over the cable during the tube manufacturing process. However, none of these methods provide the benefits of the present invention, which further addresses problems associated with supporting of heating cables and tubing containing such heating cables.

SUMMARY

Some embodiments of the invention provide a downhole heating apparatus having one or more electric heating cables, an elongated support member attached to the heating cables and receiving a mechanical load from the heating cables, and a cable hang-off configured to vertically suspend the heating cables and the support member. The cable hang-off can have a shell through which the heating cables and the support member are disposed, the shell having a bowl, and a plurality of slips that cooperate with each other and with the bowl to form a pinching member that grips and suspends the support member. The heating cables can be mineral insulated cables. The support member can be a wire rope attached to the heating cables at regular intervals with a cable support clamp. The cable support clamp can include at least one clamp body having a cable cavity for each heating cable and a rope cavity. The shell can have a cylindrical mount that receives an end of a length of coiled tubing, and the heating cables and support member can be disposed within the length of coiled tubing when the support member is suspended by the pinching member. The coiled tubing can be pressure-sealed at its opposite end from the shell, and can be filled with a dielectric fluid.

The slips can form a gripping channel in the pinching member, through which the support member is disposed when it is gripped by the pinching member. The gripping channel can have a non-slide surface formed by projections on a gripping surface of each of the slips. The slips can form one or more cable channels in the pinching member, through which the heating cables are disposed when the support member is gripped by the pinching member.

Other embodiments of the invention provide a downhole heating apparatus having one or more electric heating cables, an elongated support member that receives a mechanical load from the heating cables when the heating cables are suspended vertically by a cable hang-off, and a plurality of cable support clamps that attach the support member to the heating cables and transfer mechanical loads from the heating cables to the support member, the cable support clamps being attached to the support member and to the heating cables at regular intervals along the length of the support member. The heating cables can be mineral insulated cables. The support member can be a wire rope. In some embodiments, there are three heating cables and each cable support clamp includes a clamp body having a cylindrical center member with an outer surface and a rear surface, a first wing attached to the center member at the outer surface and having a first cable cavity and a second cable cavity, and a second wing attached to the center member at the outer surface diametrically opposite the first wing, the second wing having a third cable cavity and a rope cavity. The first and second wings can be flush with the rear of the center member, can be about twice the length of the center member in the center member's axial direction and can have an arcuate interior surface that conforms to the diameter of the center member and defines a mounting channel between the first wing and the second wing. Each of the first and second wings can further have a groove disposed in an outer surface of the wing.

Other embodiments of the invention provide a downhole heating apparatus for a wellbore, having a cable hang-off configured to be installed in a wellbore termination assembly, The cable hang-off can have a proximal end and a distal end and can include a cylindrical mount that is disposed in the distal end and receives an end of a length of coiled tubing disposed in the wellbore, a conical bowl that is disposed in the proximal end and connects with the mount, and a plurality of slips that cooperate with each other and with the bowl to form a pinching member having a gripping channel and a cable channel, an electric heating cable disposed in the coiled tubing and in the cable channel, and an elongated support member attached to the heating cable, disposed in the coiled tubing, and disposed in and gripped by the gripping channel. Each of the slips can be identical and wedge-shaped, and can have an arcuate outer surface that conforms to the bowl, a first inner surface adjacent to one end of the outer surface, and a second inner surface adjacent to the other end of the outer surface, the second inner surface being a mirror image of the first inner surface. Each of the inner surfaces can have a planar portion and an arcuate portion, the first inner surface of one slip cooperating with the second inner surface of an adjacent slip to form a cable channel in the pinching member. Each of the slips can further have an arcuate gripping surface that cooperates with the gripping surfaces of the other slips to form a gripping channel in the pinching member.

DESCRIPTION OF THE DRAWINGS

FIG. 14 is a front view of a cable support clamp of the present disclosure.

FIG. 15 is a rear view of a cable support clamp of the present disclosure.

FIGS. 16A-B are side perspective views of assembly of a cable support clamp of the present disclosure.

DETAILED DESCRIPTION

Figure 1A:
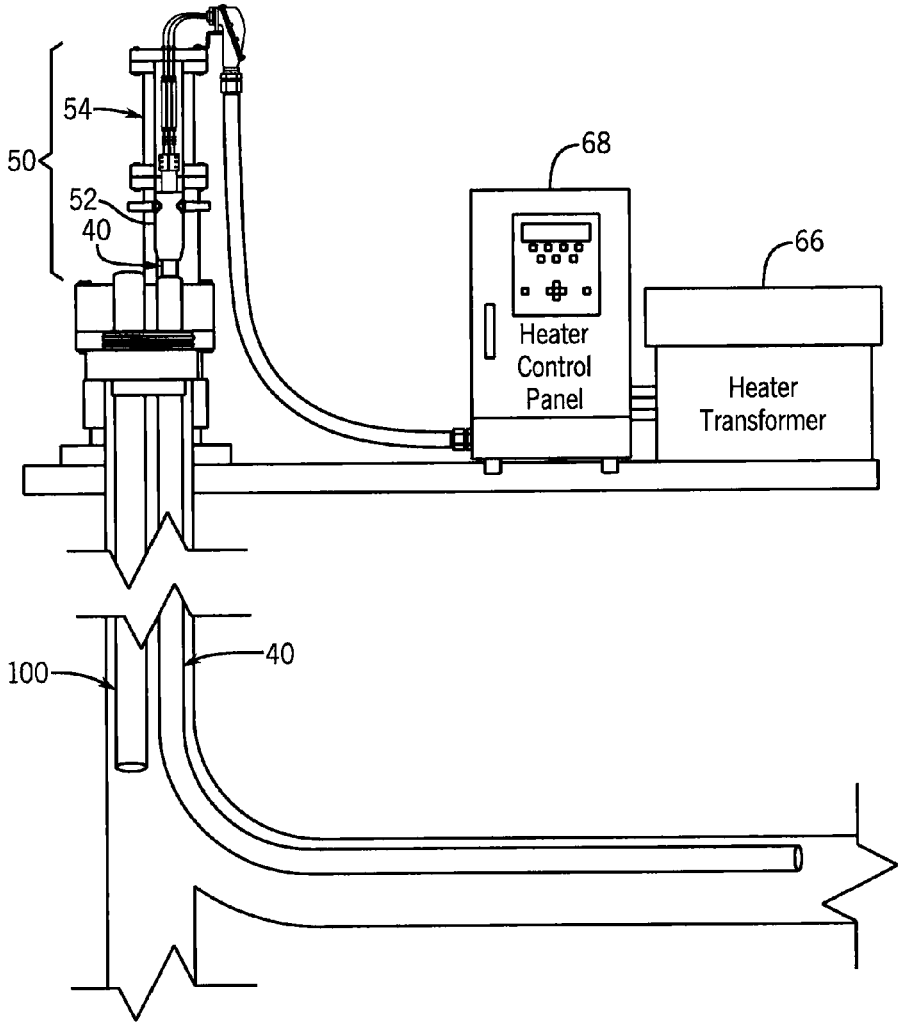
FIG. 1A is a cross-sectional schematic diagram of a heating apparatus according to the present disclosure.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 1B:
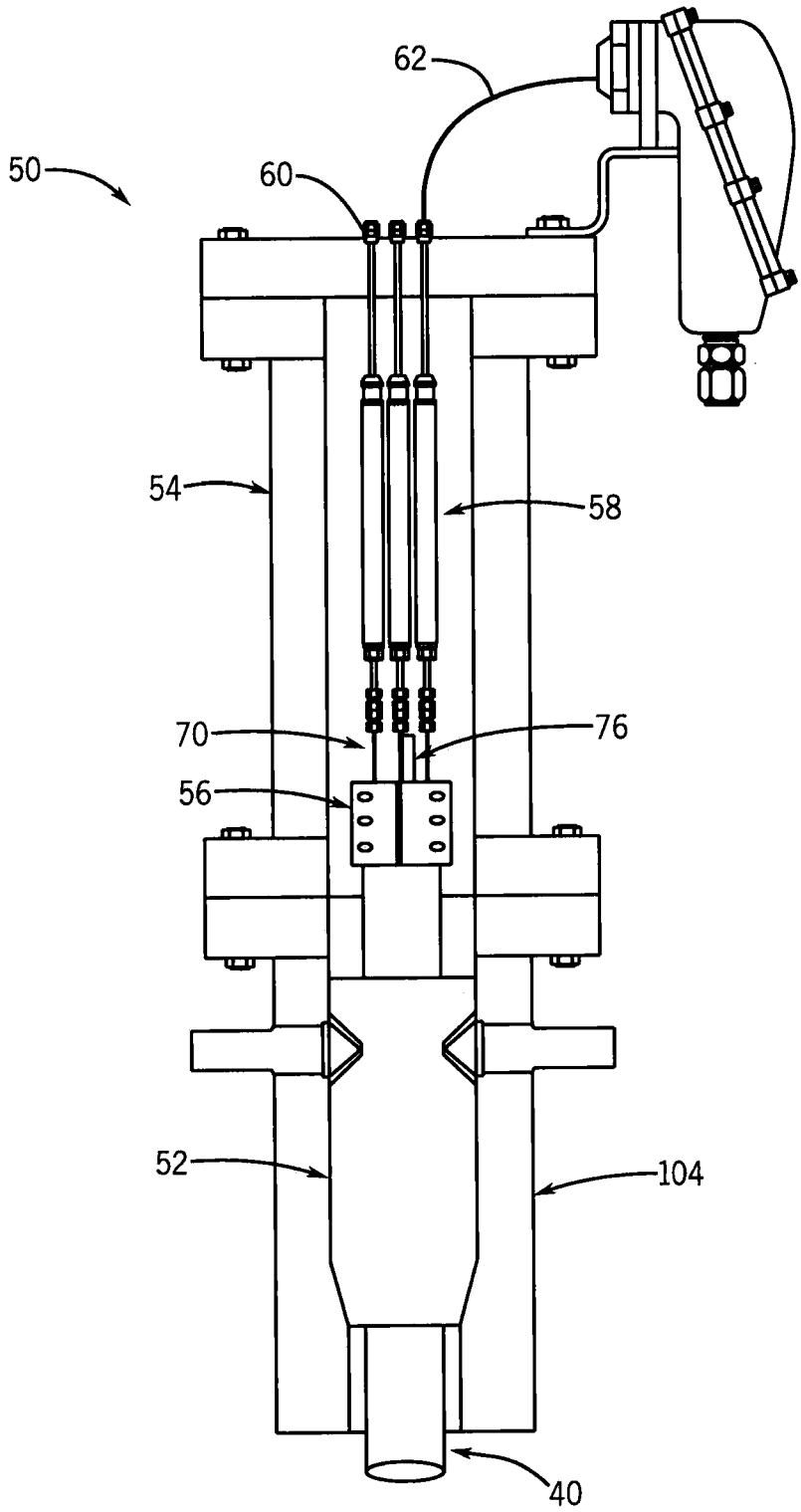
FIG. 1B is a cross-sectional schematic diagram of a wellhead termination assembly of the heating apparatus of FIG. 1A.
Figure 2:
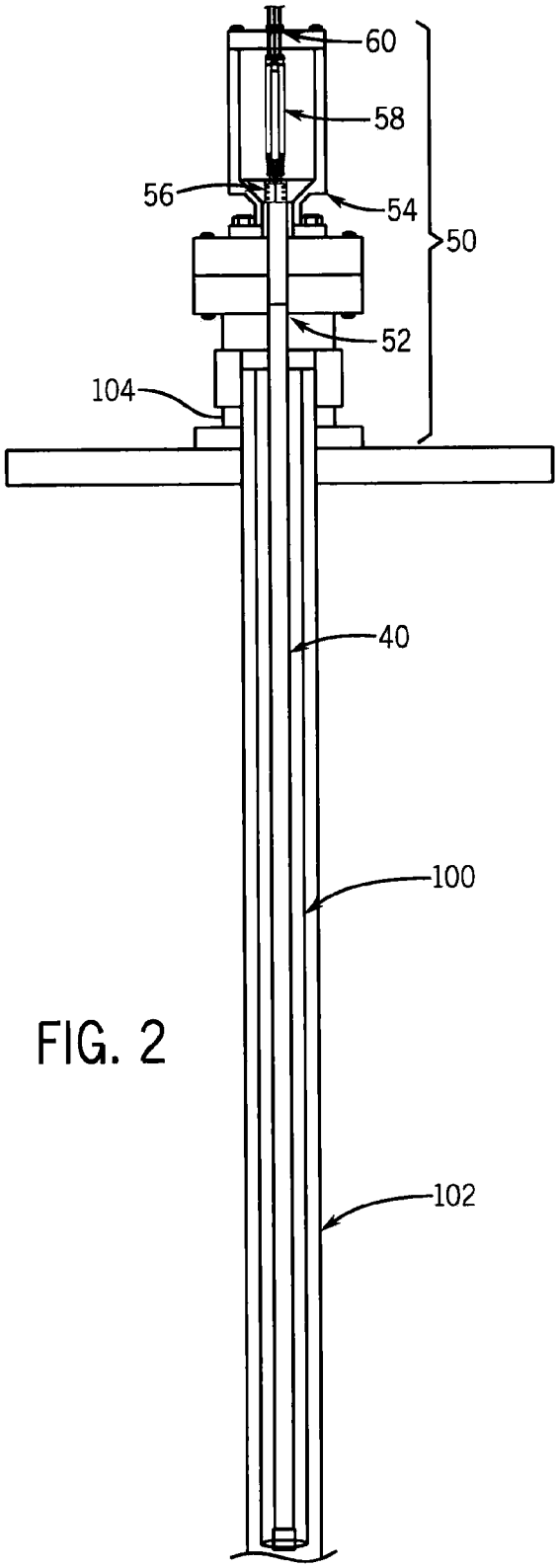
FIG. 2 is another cross-sectional schematic diagram of a heating apparatus according to the present disclosure.

Referring to FIGS. 1A, 1B, and 2, the present invention encompasses various embodiments of installing an electric heating apparatus downhole within the production tubing 100 of a wellbore 102 for the purpose of providing thermal (heat) energy to the production tubing 100, the wellbore 102, the medium contained in the wellbore 102, or the surrounding environment (i.e., reservoir). The apparatus can include a length of coiled tubing 40 containing one or more electric heating cables that provide the thermal energy. The coiled tubing 40 extends from a proximal end at or near the wellhead 104 downhole a predetermined distance to a distal end, which may be at, short of, or beyond the bottom of the production tubing 100. A tubing plug 42 located at or near the bottom end of the coiled tubing 40 can provide a pressure-tight seal between the coiled tubing 40 and the surrounding environment.

The coiled tubing 40 can be attached at its proximal end to a wellhead termination assembly 50. The wellhead termination assembly 50 can include a coiled tubing hanger 52, a termination spool 54 disposed above the coiled tubing hanger 52, and a wellhead cable hang-off 56 disposed within the termination spool 54. The coiled tubing hanger 52 hangs the coiled tubing 40 at its proximal end, substantially coaxially with the production tubing 100 as is known in the art, allowing the proximal end of the coiled tubing 40 to interface with the cable hang-off 56. The terminal spool 54 is a hollow metal cylinder that contains and protects the cable hang-off 56 and the heater termination attachments 58 for one or more electrical heating cables 70. In some embodiments, the heater termination attachments 58 can be attached to a cold lead of each heating cable 70. An electrical feedthrough 60 in the terminal spool 54 receives connecting wires 62 that connect to the termination attachments 58 and deliver power to the heating cables 70 from the transformer 66. A heater control panel 68 can be disposed in the electrical circuit that includes the cables 70, in order to control power supplied to the cables 70.

Figure 3:
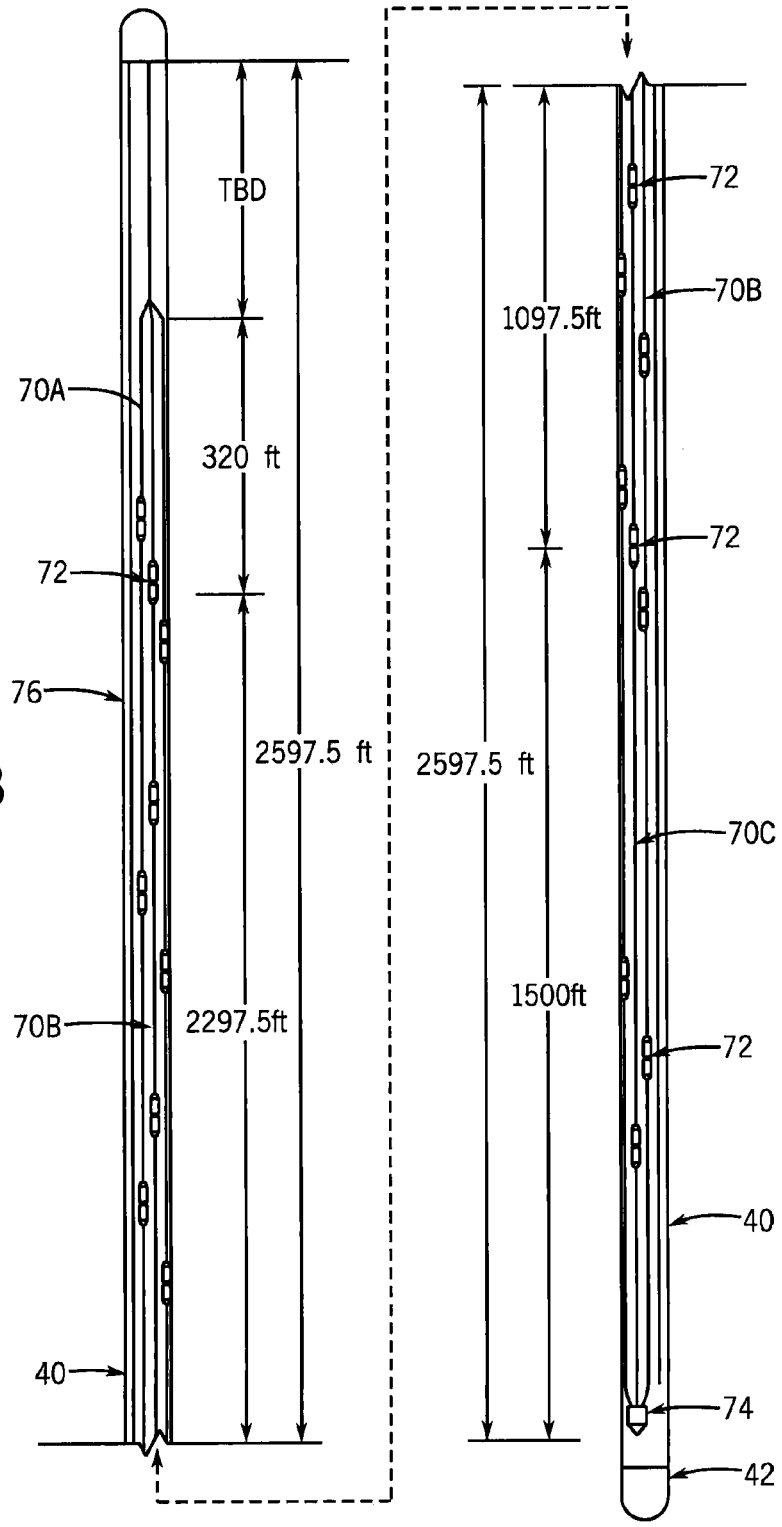
FIG. 3 is a cross-sectional schematic diagram of a length of coiled tubing according to the present disclosure.
Figure 4:
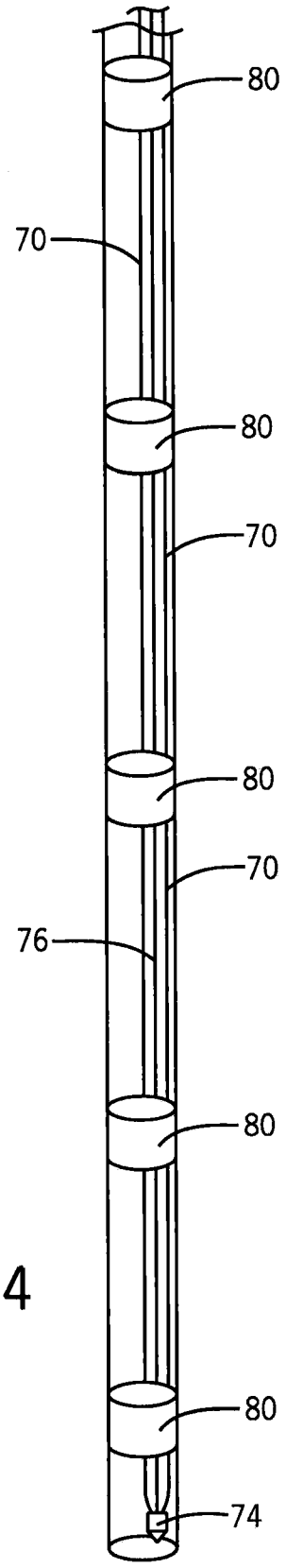
FIG. 4 is another cross-sectional schematic diagram of a length of coiled tubing according to the present disclosure.

Referring to FIGS. 3 and 4, the coiled tubing 40 can contain one or more electrical heating cables 70, such as MI cables or polymer insulated cables, that extend along all or most of the length of the coiled tubing 40 and are isolated, and thereby protected, from the surrounding wellbore 102 environment. Specifically, the cables 70 are enclosed within the coiled tube 40 and sealed off from well fluids which often contain corrosive or harsh gases and liquids which can damage the cables 70. Isolating the cables 70 from well fluids allows for the use of cables and related materials (such as, by way of illustration but not limitation, silver solder) that would otherwise not be possible in many applicable environments. Further, by allowing a broader range of materials to be used to construct the heating cables 70 and associated components, more cost effective systems can be manufactured.

Figure 5:
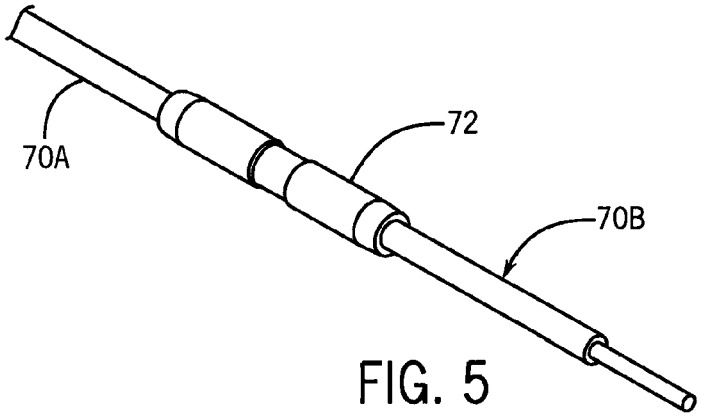
FIG. 5 is a side perspective view of an inline cable splice of the present disclosure.
Figure 6:
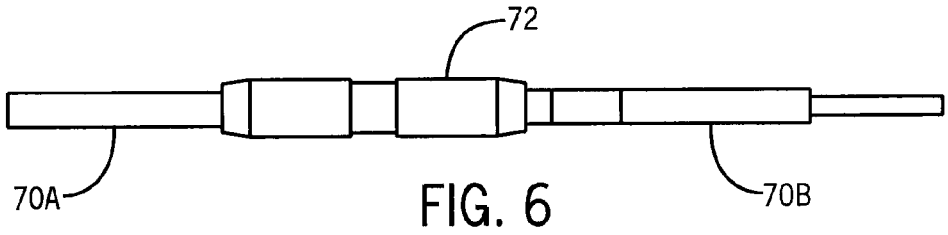
FIG. 6 is a side view of an inline cable splice of the present disclosure.
Figure 7:
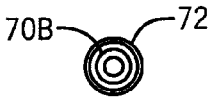
FIG. 7 is a front view of an inline cable splice of the present disclosure.
Figure 8:
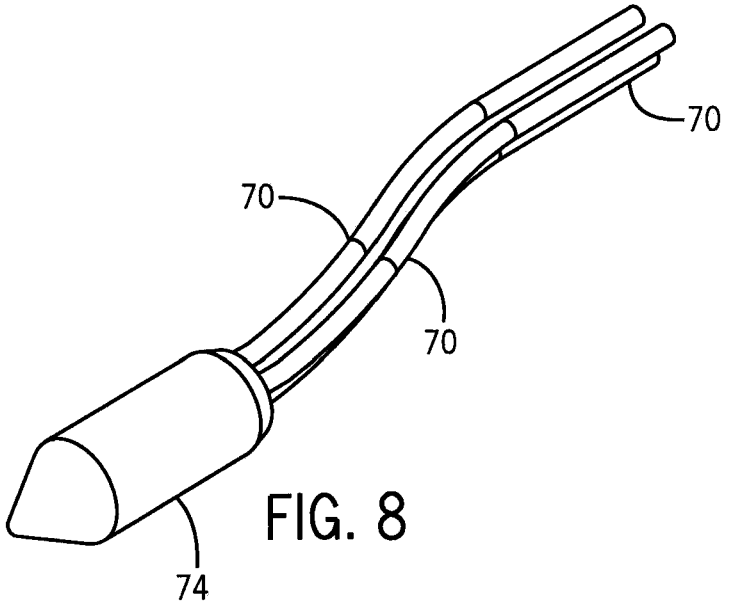
FIG. 8 is a side perspective view of a wye splice of the present disclosure.
Figure 9:
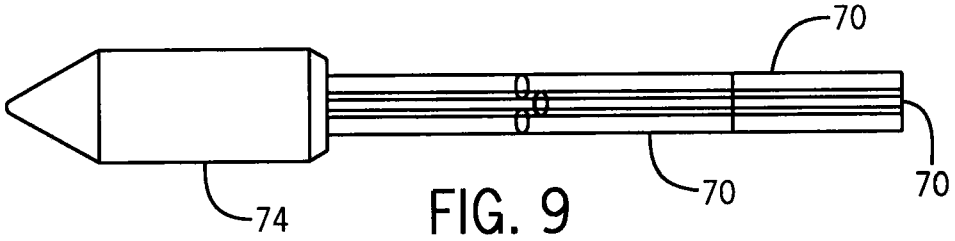
FIG. 9 is a side view of a wye splice of the present disclosure.
Figure 10:
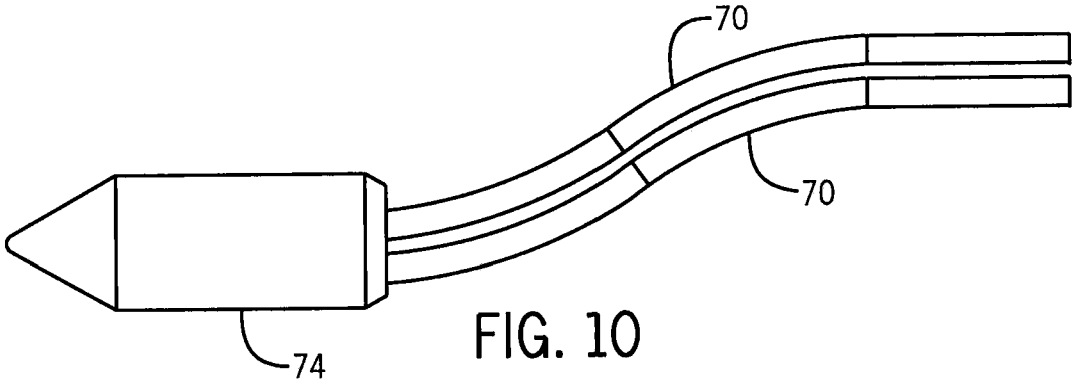
FIG. 10 is a side view of a wye splice of the present disclosure.
Figure 11:
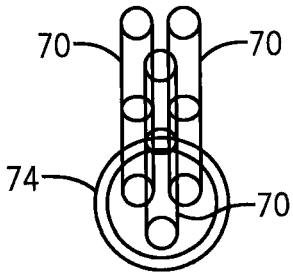
FIG. 11 is an end view of a wye splice of the present disclosure.
Figure 12:
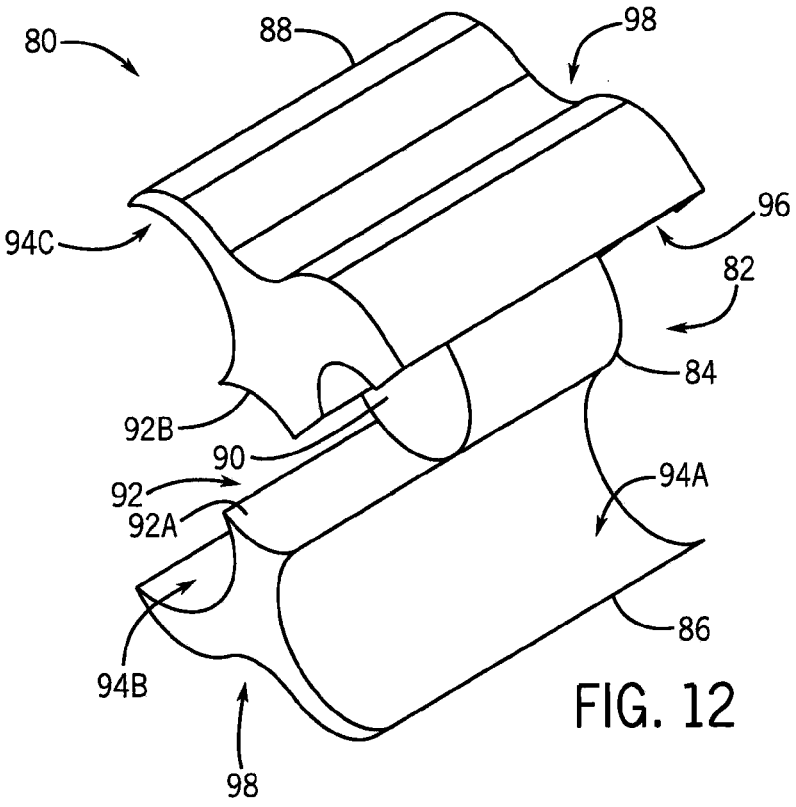
FIG. 12 is a side perspective view of a cable support clamp of the present disclosure.
Figure 13:
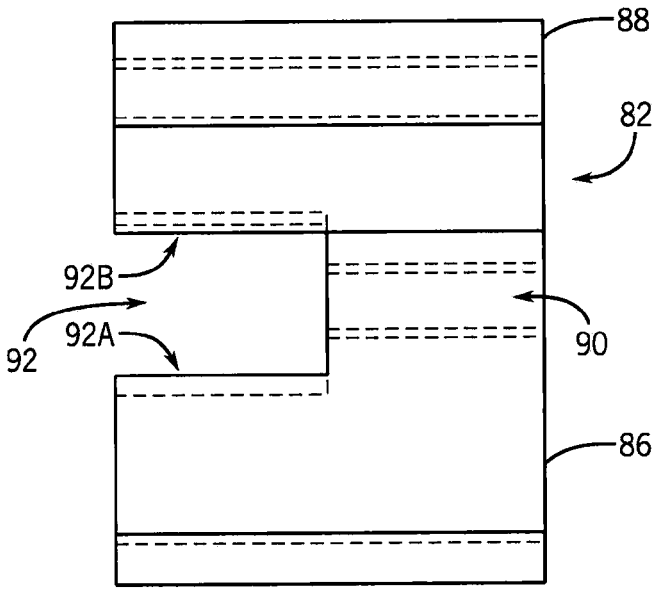
FIG. 13 is a side view of a cable support clamp of the present disclosure.

One or more of the cables 70 may be comprised of cable segments 70A, B, C, and adjacent segments may be spliced together with an inline cable splice 72. The inline cable splice 72 depicted in FIGS. 5-7 is a splice which can connect two or more heating cables from the same electrical circuit phase inline so as to facilitate longer circuit lengths. Typically, cable segments 70A, B enter/exit the splice from opposite ends. In some embodiments, one or more of the cables 70 can be comprised of segments 70A-C with different properties in order to deliver different amounts of thermal energy along the length of the coiled tubing 40. For example, a cable 70 can have a cold lead 70A that has a very narrow conductor or very thick insulator to radiate little or not thermal energy, a warm lead 70B having properties that cause it to radiate some thermal energy, and a hot lead 70C that comparatively delivers the most thermal energy to its surroundings. The lead segments 70A-C can be further spliced with inline cable splices 72 as shown in FIG. 3.

Separate cables 70 may be spliced together or co-terminated with a wye splice 74 or end cap, respectively. The cable wye splice 74 (or end cap) depicted in FIGS. 8-11 is a splice which connects two or more cables 70 from different electrical circuit phases together to form a closed circuit at the electrical terminal (i.e., distal) end of the heater system. While the wye splice 74 is disposed at the distal end of the coiled tubing 40 in FIGS. 3 and 4, it is not required to be so located, as it is possible to "loop back" cables 70 for some distance in order to increase power output in a portion of the coiled tubing 40. Typically, all spliced cables 70 enter the wye splice 74 from the same end, and no cables 70 enter or exit the wye splice 74 from the opposite end.

Referring again to FIGS. 3 and 4, the coiled tubing 40 can further contain a high-strength, elongate support member 76, such as a wire rope, extending along the length of the coiled tubing 40 substantially parallel and in proximity to the heating cables 70. The support member 76 can be attached to the heating cables 70 for the purpose of transferring mechanical load onto the support member 76. The support member 76 provides tensile strength for purposes of pulling the cables 70 into the coiled tubing 40 during the manufacturing or assembly process, and also for the purposes of providing additional tensile strength when the coiled tubing 40 and the cables 70 are disposed vertically inside the wellbore 102 or another installation. In some embodiments, the support member 76 can be attached to some or all of the cables 70 at regular intervals along the length of the support member 76 with cable support clamps 80. The cable support clamp 80 is used to make a mechanical connection between cables 70 and the elongate support member 76 in order to transfer mechanical loads from the cables 70 to the support member 76. A cable support clamp 80 can attach all or a subset of the cables 70 to the support member 76.

FIGS. 12-16B illustrate an exemplary cable support clamp 80 for the heating system of FIGS. 3 and 4, which has three cables 70 and one wire rope (i.e., support member 76). The cable support clamp 80 can include at least one clamp body 82 having a cylindrical center member 84 and substantially diametrically opposed wings 86, 88 attached to or integral with the center member 84 at the outer surface of the cylinder. The center member 84 can include a centrally disposed bore 90. The bore 90 may be partially or completely threaded for receiving a bolt 128, or may be otherwise configured to receive an attachment device for attaching another clamp body 82 as described below. Each wing 86, 88 is flush and coplanar with the rear of the center member 84 and is twice the length of the center member 84 in the axial direction, therefore extending past the front of the center member 84 for the length of the center member 84. The front surfaces of the wings 86, 88 are coplanar. A mounting channel 92 separates the wings 86, 88 and is defined by an arcuate interior surface 92A,B on each wing 86, 88 that conforms to the diameter of the center member 84.

Each wing 86, 88 can include one or more cavities that are configured to cooperate with corresponding cavities in the corresponding wing 86, 88 of another clamp body 82. A first wing 86 can include a first cable cavity 94A and a second cable cavity 94B, while the opposing second wing 88 can include a third cable cavity 94C and a rope cavity 96. The cable cavities 94A-C each hold a cable 70 and therefore may be the same size (i.e., cavity radius). The rope cavity 96 can have a smaller radius than the cable cavities 94A-C. Any of the cavities 94A-C, 96 can further have a tapering profile, such that the cavity radius is larger at one end of the wing 88 than at the other. The tapering profile allows the cable support clamp 80 to pinch, and thereby grip, the cables 70 and support member 76 when the smaller cavity radius is less than the radius of a cable 70 or the support member 76. Each wing 86, 88 can further include one or more grooves 98 disposed in the outer surface of the wing 86, 88. The grooves 98 can facilitate the passage of a fluid that is used to fill the coiled tubing 40 if the coiled tubing 40 is being filled as described below when the cable support clamps 80 are present therein.

Figure 16B:
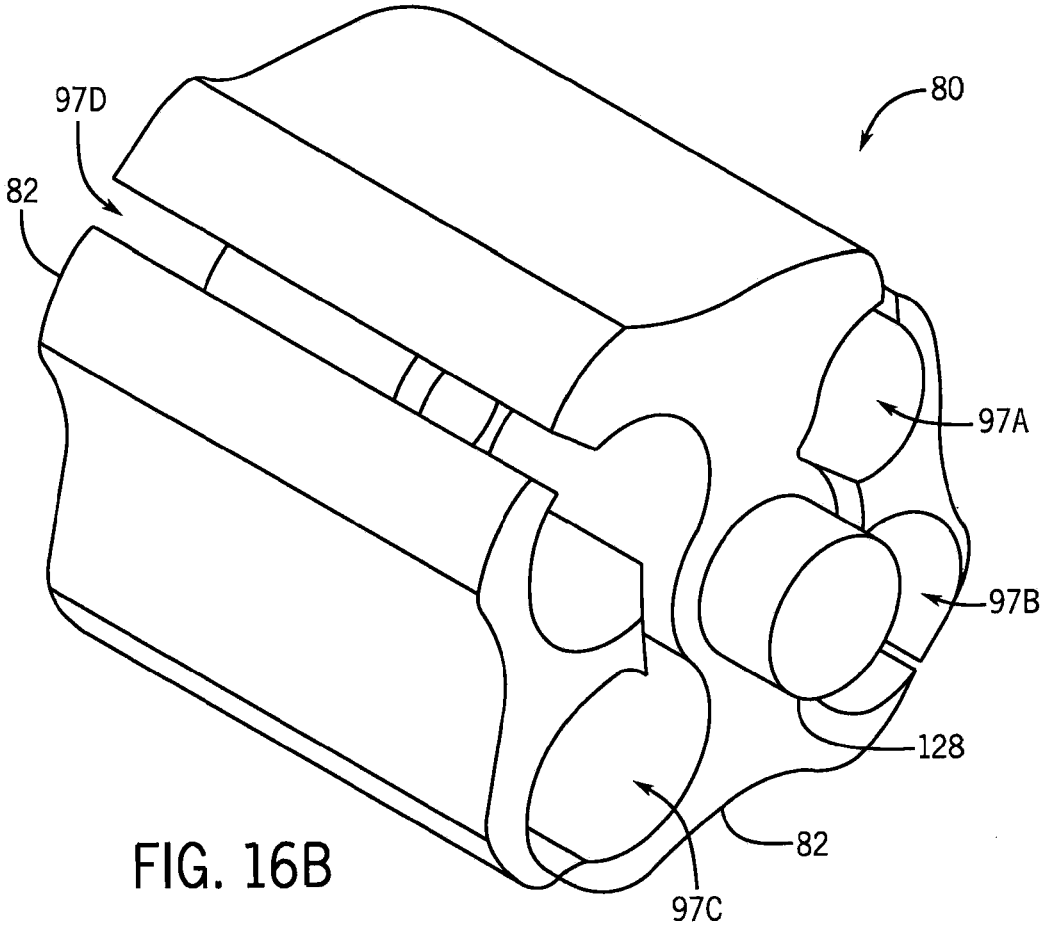
Figure 17:
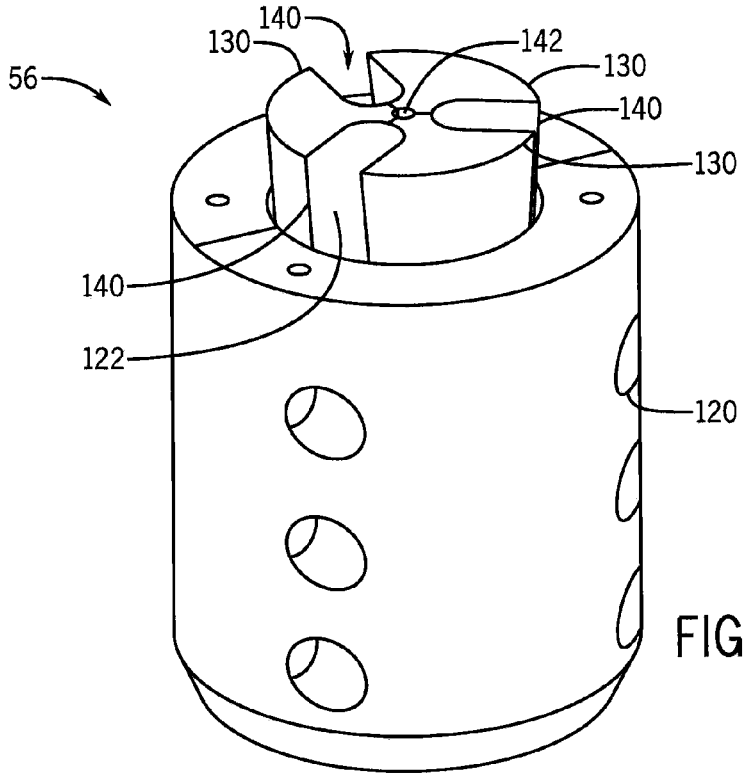
FIG. 17 is a front perspective view of a cable hang-off of the present disclosure.
Figure 18:
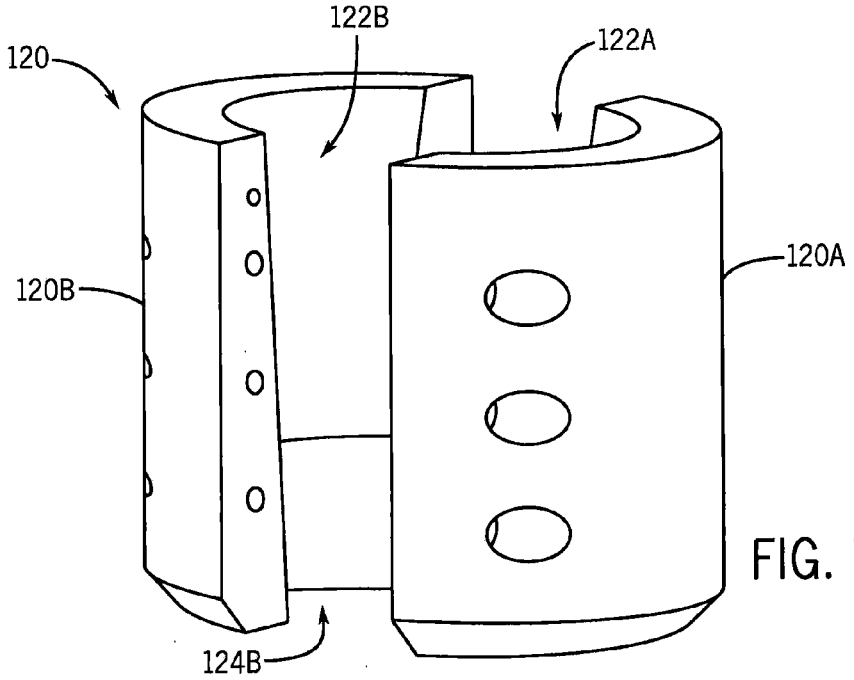
FIG. 18 is a side perspective view of a shell of a cable hang-off of the present disclosure.
Figure 19:
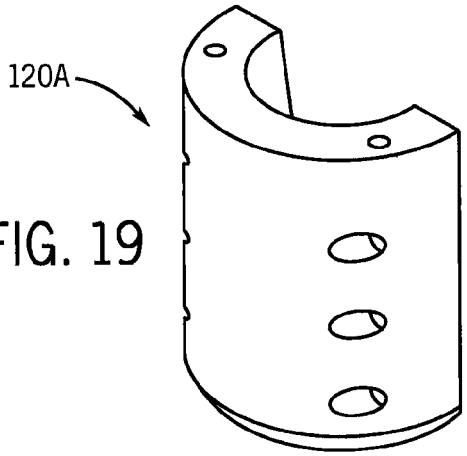
FIG. 19 is a side perspective view of a shell half of a cable hang-off of the present disclosure.
Figure 20:
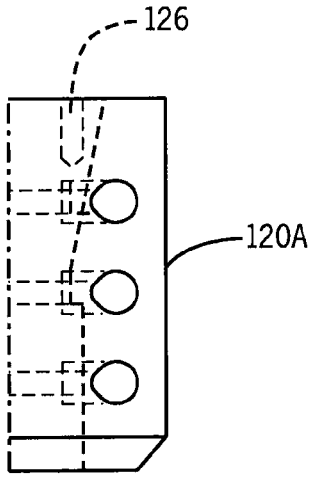
FIG. 20 is a side view of a shell half of a cable hang-off of the present disclosure.
Figure 21:
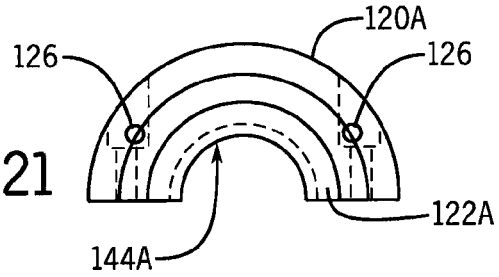
FIG. 21 is a top view of a shell half of a cable hang-off of the present disclosure.
Figure 22:
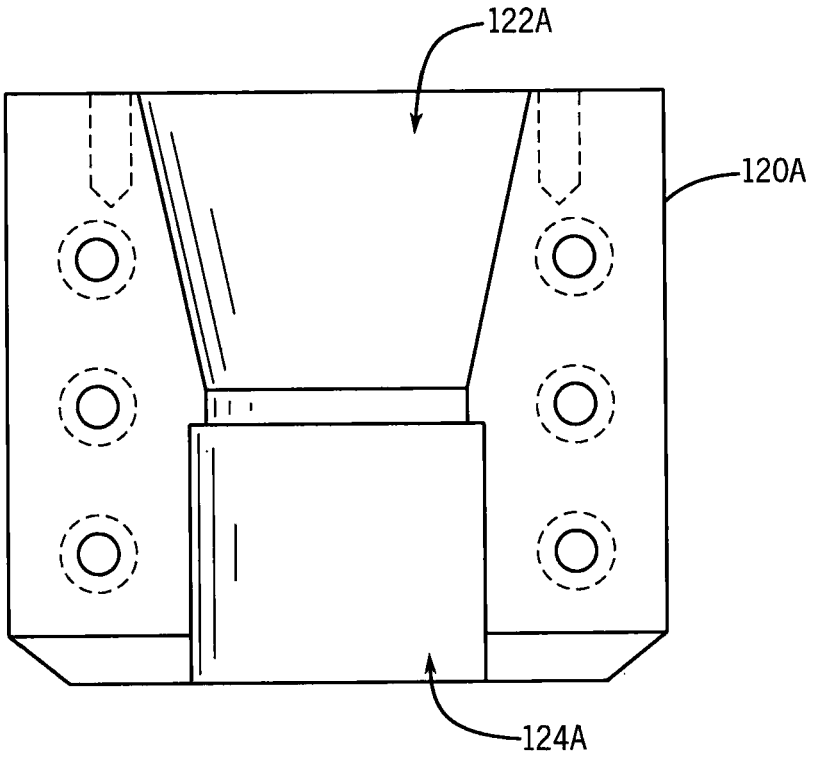
FIG. 22 is a rear view of a shell half of a cable hang-off of the present disclosure.

As shown in FIGS. 16A-B, in some embodiments the cable support clamp 80 can include two substantially identical clamp bodies 82 oriented in opposite axial directions and at a 90-degree angle to each other. With the bores 90 of the clamp bodies 82 aligned, the clamp bodies 82 interface with each other, the central member 84 of one clamp body 82 sliding into the mounting channel 92 of the opposing clamp body until the central members 84 abut each other. A bolt 110 or other suitable attachment device can then be inserted through the bores 90 to attach the clamp bodies 82 to each other. Each cable cavity 94A-C and the rope cavity 96 of one clamp body 82 cooperates with the corresponding cable cavities 94A-C and rope cavity 96 of the other clamp body 82 to create clamp channels 97A-D for each heating cable 70 and the support member 76.

A suitable interval for attaching the cable support clamps 80 can depend on several factors, including the length and diameter of the cables 70 and support member 76, the trajectory of the wellbore 102, and the inherent material tolerances of the cable support clamp 80. The apparatus can include cable support clamps 80 of different sizes, including clamp body 82 size and clamp channel 97A-D diameters, for different sized heating cables 70. The material of the clamp bodies 82 can have high heat tolerance to resist deformation that might cause the cables 70 or support member 76 to slip at high temperatures. In one working example, an apparatus disposed in vertically-hung and air-filled coiled tubing 40, and having three heating cables 70 and one wire rope as the support member 76, has the following characteristics:

| | |
|---|---|
| Free-hanging cable total length | 5195 ft. |
| Cold lead segment 70A length (approx.)/dia. | 320 ft./0.496 in. |
| Warm lead segment 70B length (approx.)/dia. | 3395 ft./0.355 in. |
| Hot lead segment 70C length (approx.)/dia. | 1500 ft./0.286 in. |
| Approx. hanging weight of cables 70 and wire rope | 10,134 lb. |
| Clamp 80 spacing | 100 ft. (75 ft. in cold lead segment 70A) |
| Clamp 80 quantity/load for cold lead segment 70A | 6/115 lb. |
| Clamp 80 quantity/load for warm lead segment 70B | 34/75 lb. |
| Clamp 80 quantity/load for hot lead segment 70C | 15/48 lb. |

The illustrated clamp 80 may be comprised substantially of carbon steel, in which case the clamps 80 of each of the three sizes needed for the working example can support a load of 275-300 lbs. at a temperature of 185 F-220 F. In other embodiments, the clamp 80 can be stainless steel or another suitable material.

In some embodiments, the coiled tubing 40 may be filled with at least one fluid which serves a variety of beneficial purposes. Said at least one fluid can improve heat transfer between the cables and the tubing, thereby allowing higher power output and higher system operating temperature. Fluid filling also provides a means of tube integrity monitoring including, without limitation, by way of the measurement of the fluid pressure or level inside the tube. Fluid filling further provides a buoyancy effect on the heating cables 70 and support member 76, relieving some of the mechanical load on the clamps 80 and cable hang-off 56. In the working example, the coiled tubing 40 can receive approximately 400 gal. of a dielectric fluid, such as transformer oil, mineral oil, or another dielectric oil, leaving a safety gap of about 250 ft. to the wellhead, allowing sufficient expansion volume of the fluid at expected temperatures to prevent an overflow and keep air pressures within the system at a manageable level. This configuration relieves about 800 lb. of the above hanging weight.

Referring to FIGS. 17-25, the wellhead cable hang-off 56 can be used to suspend the cables 70 and support member 76 (e.g., wire rope) within the coiled tubing 40 or other structure, usually at the uppermost extent of the heater system where electrical power will be connected to the cables 70. In particular, the cable hang-off 56 can provide the requisite mechanical support to hold the support member 56 at or near its proximal end, allowing the support member 56 and the cables 70 to extend downhole within the coiled tubing 40.

Referring to FIGS. 17-22, the cable hang-off 56 can include a shell 120 having a distal end that fits over the proximal end of the coiled tubing 40, and a proximal end that receives a plurality of slips 130. The shell 120 can be divided into two halves 120A,B that can be identical, or at least substantially symmetrical. The halves 120A,B can be semi-cylindrical, with planar faces that abut each other and receive bolts or other attachment devices to hold the halves 120A,B together. Each half 120A,B of the shell 120 has a plurality of cavities that cooperate with the cavities of the opposing half 120A,B to form a plurality of receptacles in the shell 120: the proximal cavities 122A,B cooperate to form a conical bowl 122 that receives the slips 130; and, the distal cavities 124A,B cooperate to form a cylindrical mount 124 that receives the proximal end of the coiled tubing 40. The proximal face of the shell 120 can include a plurality of bolt holes 126. The distal end of the shell 120 can be beveled.

Figure 23:
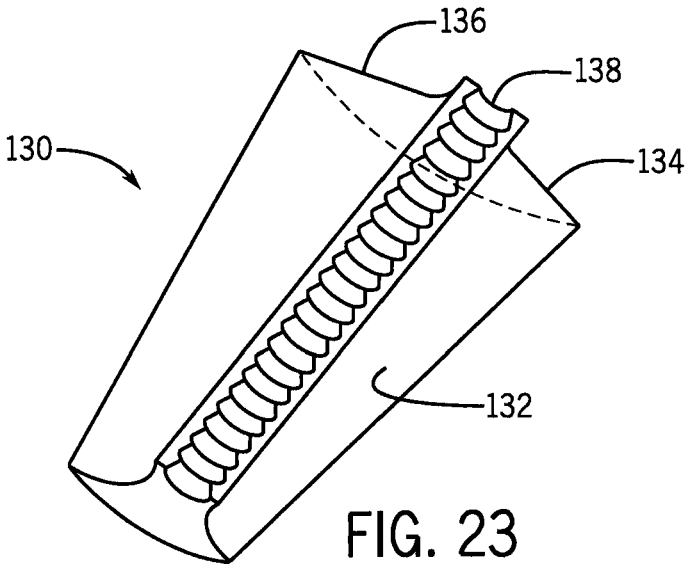
FIG. 23 is a front perspective view of a slip of a cable hang-off of the present disclosure.
Figure 24:
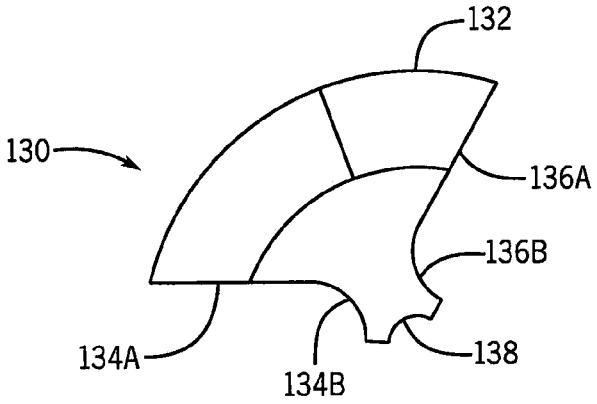
FIG. 24 is a top view of a slip of a cable hang-off of the present disclosure.
Figure 25:
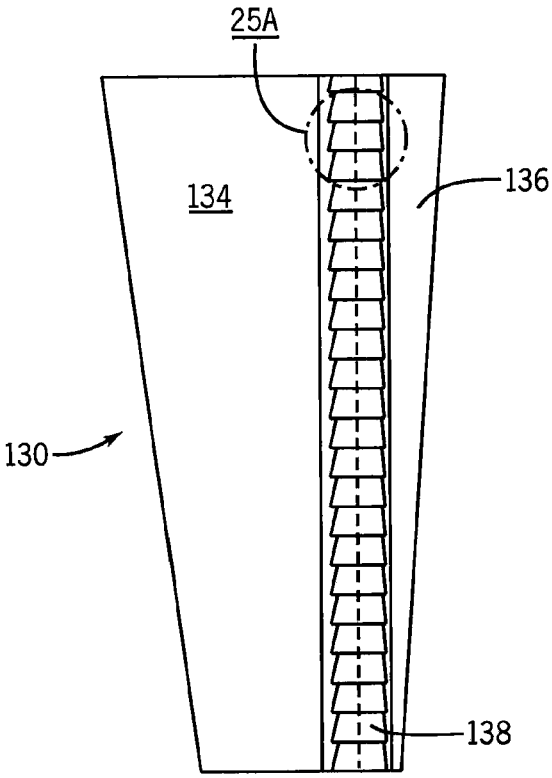
FIG. 25 is a side view of a slip of a cable hang-off of the present disclosure.
Figure 25A:
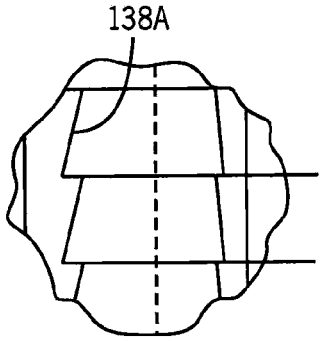
FIG. 25A is an inset detail view of area 25A of FIG. 25.
Figure 26:
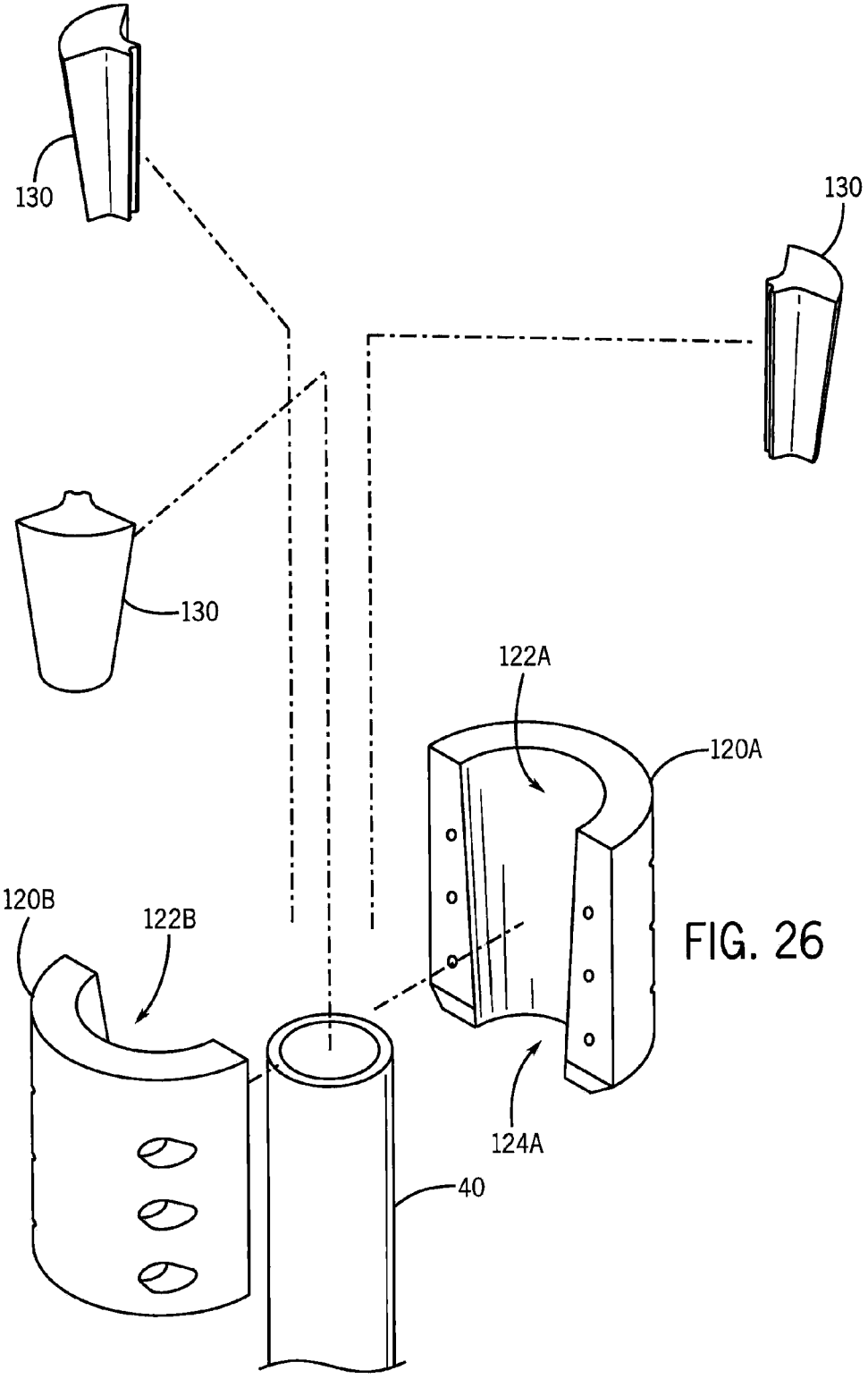
FIG. 26 is a front perspective view of a cable hang-off of the present disclosure being assembled over a proximal end of a coiled tubing.
Figure 27:
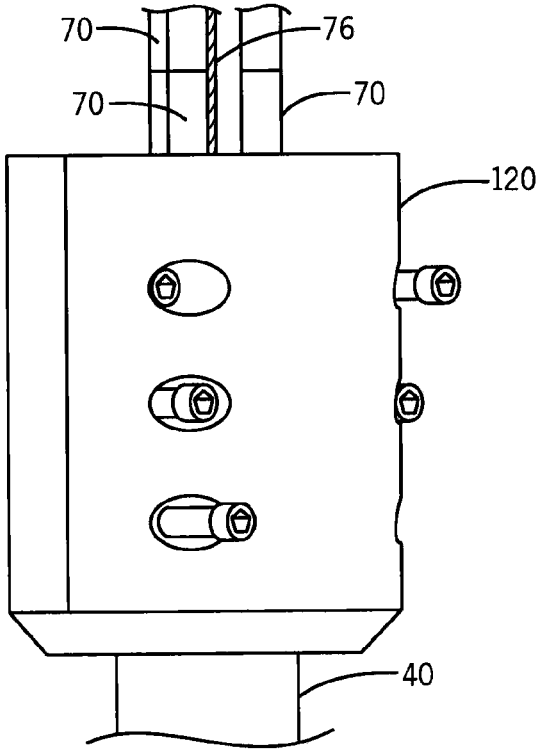
FIG. 27 is a side view of a cable hang-off of the present disclosure being assembled over a proximal end of a coiled tubing.
Figure 28:
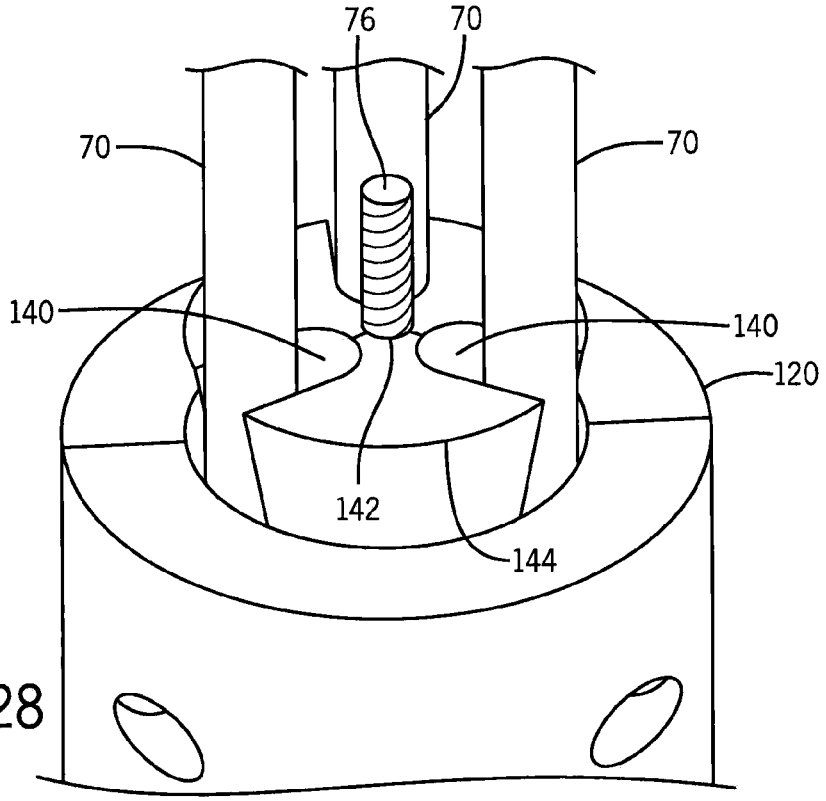
FIG. 28 is a front perspective view of a cable hang-off of the present disclosure being assembled over a proximal end of a coiled tubing.
Figure 29:
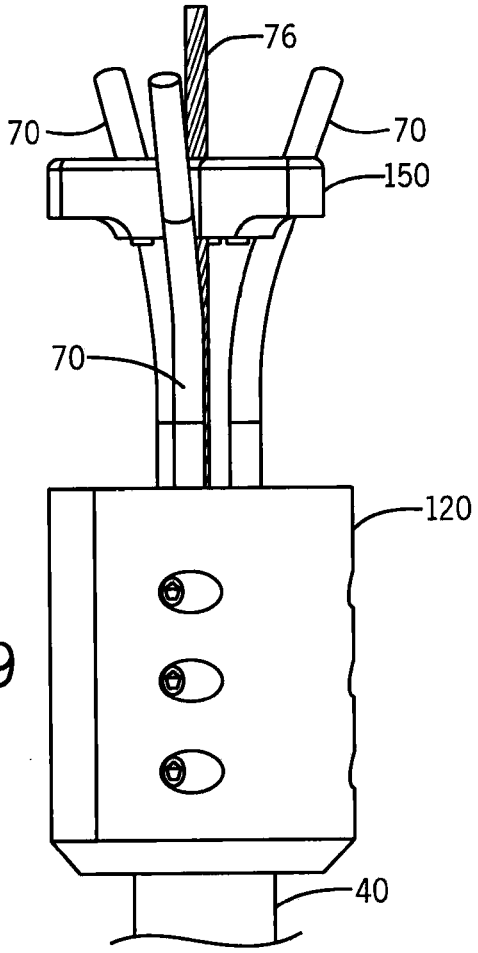
FIG. 29 is a side view of a cable hang-off of the present disclosure being assembled using a pressure plate.
Figure 30:
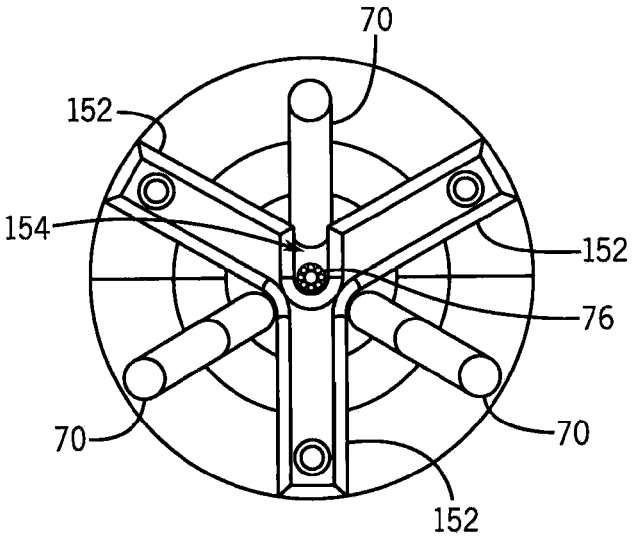
FIG. 30 is a top view of a cable hang-off of the present disclosure being assembled using a pressure plate.
Figure 31:
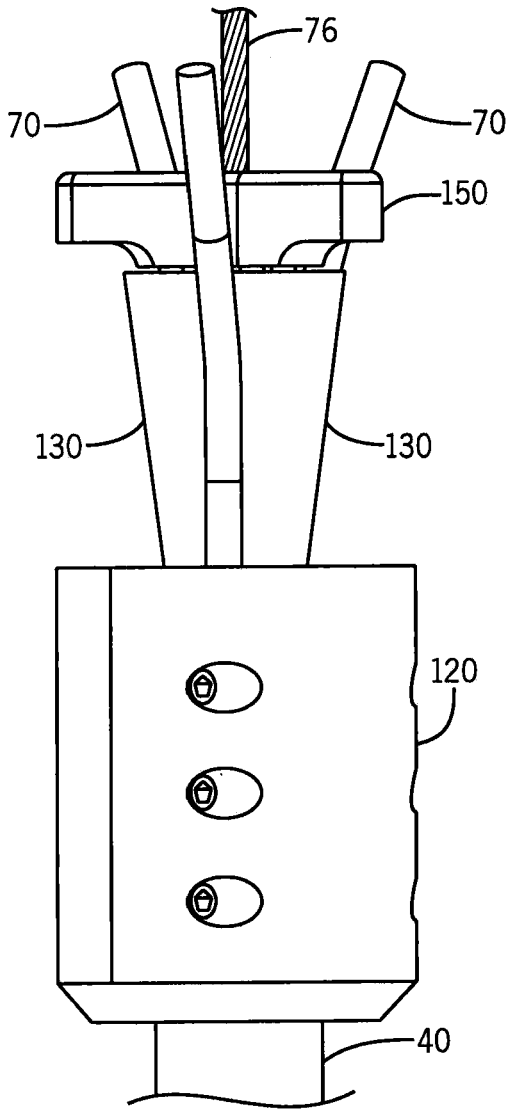
FIG. 31 is a side view of a cable hang-off of the present disclosure being assembled using a pressure plate.
Figure 32:
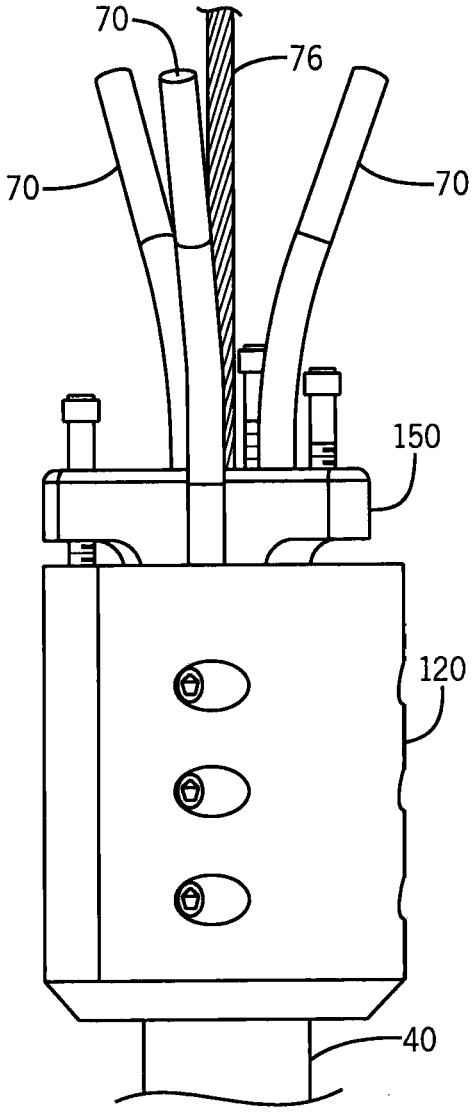
FIG. 32 is a side view of a cable hang-off of the present disclosure being assembled using a pressure plate.

Referring to FIGS. 23-25, the slips 130 are wedge-shaped members that cooperate to form a conical pinching member that suspends the support member 76 via friction fit. Specifically, the slip 130 tapers from a proximal end to a distal end, and has an arcuate outer surface 132 that conforms to the radius of the bowl 122. The slip 130 can have first and second inner surfaces 134, 136 that are adjacent to each end of the outer surface 132. The first and second inner surfaces 134, 136 are mirror images of each other, each having a planar portion 134A, 136A and an arcuate portion 134B, 136B. In this configuration, the first inner surface 134 cooperates with the second inner surface 136 of an adjacent slip 130 to form a cable channel 140. See FIG. 17. The slip 130 can further have an arcuate gripping surface 138 positioned to cooperate with the gripping surfaces 138 of the other slips 130 to create a substantially circular gripping channel 142 that is coaxial with the shell 120. See FIG. 17. The gripping surface 138 may have studs, ribs, teeth, or other projections 138A, as shown in FIG. 25A, that give the gripping channel 142 a slide-resistant surface.

Referring to FIGS. 26-32, the halves 120A,B of the shell 120 can be assembled over the coiled tubing 40. For the example system having three cables 70 and one wire rope (i.e., support member 76), three slips 130 assemble by being inserted into the bowl 122 to form the pinching member 144, with the gripping channel 142 encircling and gripping the wire rope, and the cable channels 140 disposed around the cables 70. The slips 130 can be mechanically inserted into the bowl 122 into contact with the wire rope so that the gripping channel 142 grips the wire rope. The apparatus can then be allowed to hang, such that the friction between the gripping channel 142 and the wire rope pulls the slips 130 downward and inward within the bowl 122 to their tightest-fitting position. Additionally or alternatively, a pressure plate 150 as shown in FIGS. 29-32 can be used to mechanically urge the slips 130 into their tightest-fitting position. The pressure plate 150 can have an arm 152 for contacting each of the slips 130. The arms 152 meet at the center of the pressure plate 150, and can define a fitting recess 154 that surrounds the wire rope so that the wire rope is centered at the center of the pressure plate 150. The pressure plate 150 can push the slips 130 into place, and then can be attached to the shell 120, such as with one or more bolts driven into the bolt holes 126.

Figure 33:
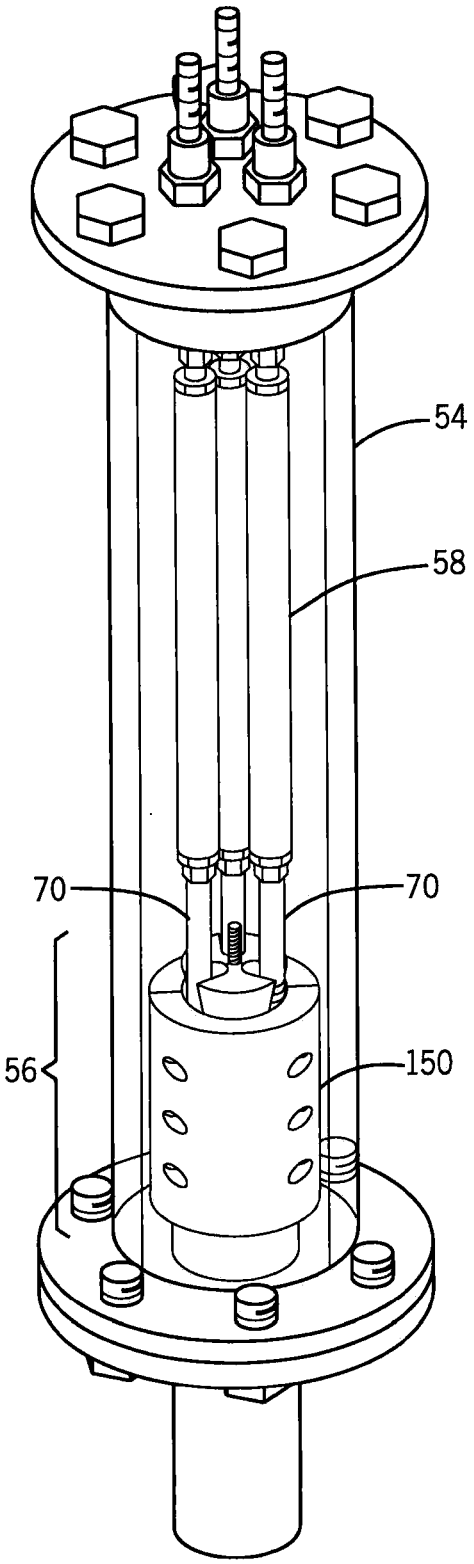
FIG. 33 is a side perspective view of a wellhead termination assembly of the present disclosure, shown with the terminal spool in broken lines.
Figure 34:
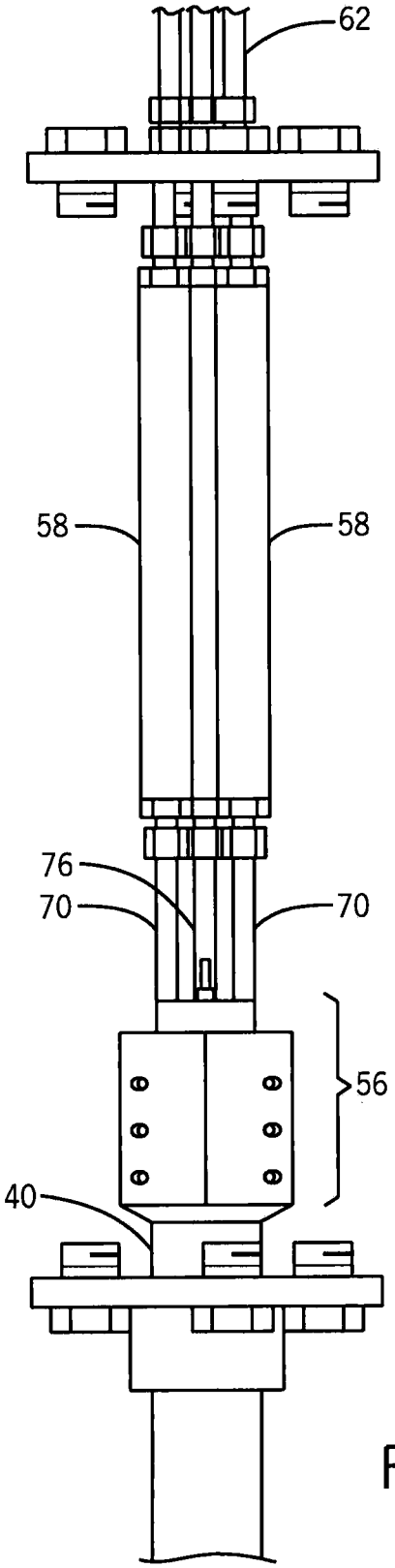
FIG. 34 is a side view of a wellhead termination assembly of the present disclosure, shown with the terminal spool removed.
Figure 35:
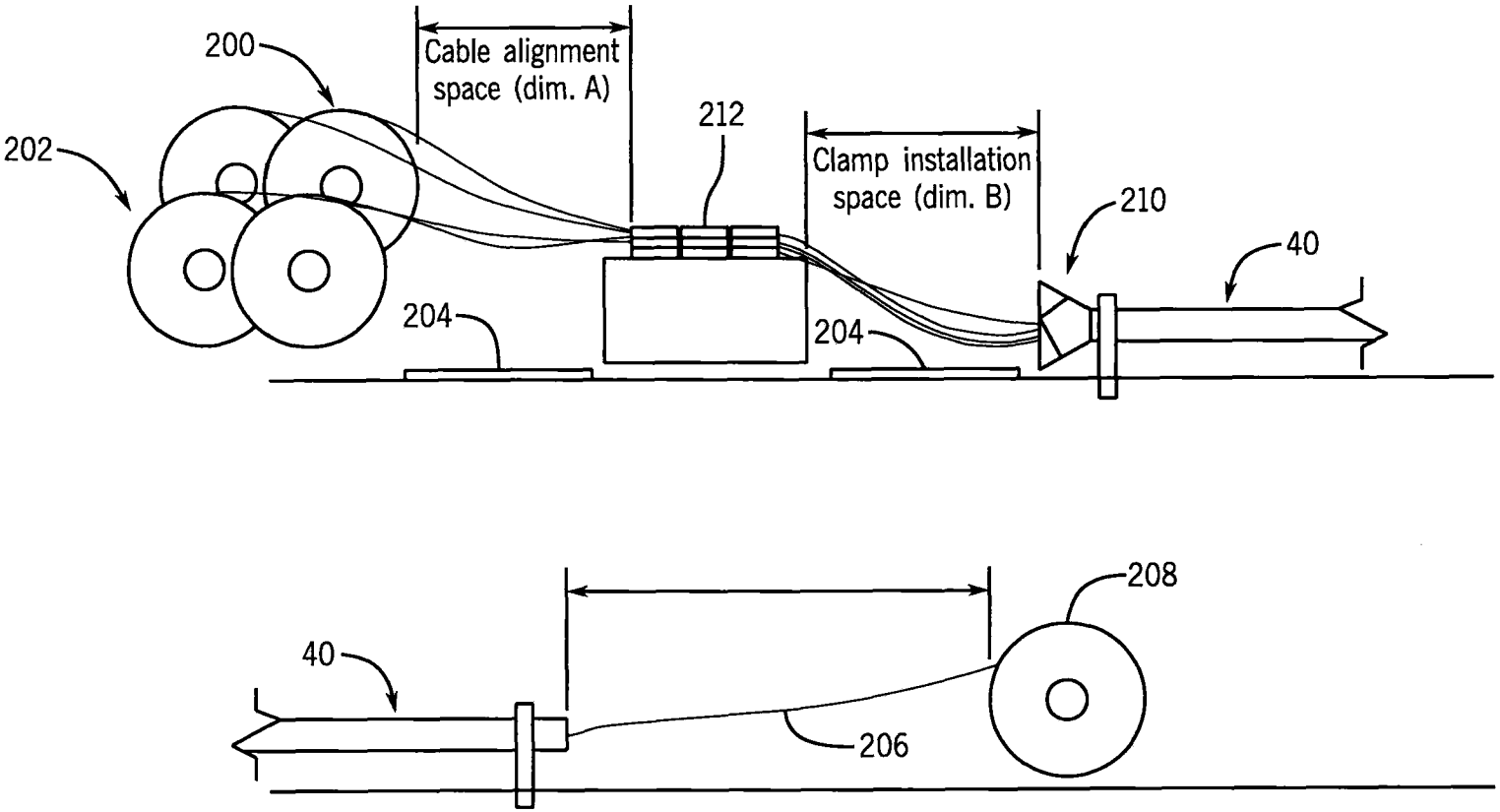
FIG. 35 is a plan view of a method of manufacturing the heating apparatus according to the present disclosure.

Referring to FIGS. 33 and 34, the proximal ends of the cables 70 can extend proximally out of the cable hang-off 56 and connect electrically to cable terminators 58. The cable terminators 58, in turn, connect electrically to wires 62 that extend out of the termination spool 54 through the electrical feedthrough(s) 60.

Another feature or embodiment of the present invention comprises a method of manufacturing the apparatus by installing the cable into the coiled tubing 40, such as with a sinker bar if the coiled tubing 40 is installed in a vertical well, or with a horizontal pull into horizontally-laid coiled tubing 40. For horizontal installation, the coiled tubing 40 is laid flat and cut to length. One or more heating cable spools 200, each carrying a heating cable 70, and a support member spool 202 are positioned at the distal (i.e., downhole) end of the coiled tubing 40. A cable alignment space A and a clamp installation space B (of at least 100 ft) may be left between the spools 200, 202 and the coiled tubing 40. Protective members 204, such as one or more sheets of plywood, may be laid in the path between the spools 200, 202 and the coiled tubing 40. A funnel 210 can be attached to the distal end of the coiled tubing 40 to facilitate running the cables 70. The cables 70 and support member 76 are paid out of the spools 200, 202. The cables 70 can be run through a cable straightener 212 with the support member 76 being drawn out of the way of (i.e. alongside, under, or over) the straightener 212. Then, the proximal ends of the cables 70 and support member 76 are attached to a pull-rope 206, which is disposed inside the coiled tubing 40 and attached to a pull-rope spool 208 at the proximal end of the coiled tubing 40.

Before drawing the cables 70 and support member 76 into the coiled tubing 40, the first clamp 80 is installed about one foot from the proximal ends of the cables 70 and support member 76. The cables 70 and support member 76 are then drawn into the coiled tubing 40 by slowly retracting the pull-rope 206. As the pull-rope 206 is retracted, the clamps 80 can be continuously installed at the desired interval until the distal ends of the cables 70 are about three feet from the distal end of the coiled tubing 40. If used, the wye splice 74 can be installed on the distal ends of the cables 70 using any suitable connection method. The wye splice 74 can be pushed into the end of the coiled tubing 40 and the tubing plug 42 installed. At the proximal ends, any slack in the cables 70 can be pulled out, and then the cables 70 and support member 76 can be separated from the pull-rope 206 and cut back to a desired length. Where the support member 76 is a wire rope, the wire rope can be left about one foot longer than the cables 70 to facilitate looping and crimping the wire rope for hanging. The coiled tubing 40 with the cables 70, support member 76, and clamps 80 installed can then be wound onto a shipping spool (not shown).

Another feature or embodiment of the present invention comprises a method of installing the apparatus in a wellbore 102. The shipping spool and cable hang-off 56 are delivered to the installation site. The coiled tubing 40 is deployed into the production tubing 100 and then suspended by the coiled tubing hanger 52 as is known in the art, while the proximal end of the support member 76 is attached to a temporary hanging device, such as by placing the crimped loop on a hook (not shown in FIGS.). The shell 120 of the cable hang-off 56 can be split into its halves 120A,B, see FIG. 26, and then bolted back together so that the proximal end of the coiled tubing 40 is disposed in the mount 124 of the shell 120 and the cables 70 and support member 76 project proximally out of the shell 120. See FIG. 27. The cables 70 are spread apart and the pressure plate 150 is inserted around the support member 76. See FIGS. 29, 30. The slips 130 are then positioned over the bowl 122 in contact with the underside of the pressure plate 150, see FIG. 31, and then driven into place in the bowl 122. See FIGS. 28 and 32. The pressure plate 150 can be attached to the shell 120 with bolts or other attachment devices. See FIG. 32. The slips 130 thereby form the pinching member 144 having its tightest-fitting position, gripping the support member 76. The tension of the temporary hanging device can be drawn to zero to test for slippage of the support member 76 within the gripping channel 142. If there is no slippage, the support member 76 can be cut or otherwise removed from the temporary hanging device and the termination attachments 128 can be attached to the cables 70. See FIG. 34.

Structural/functional differences between the present invention and the prior art include, without limitation, the following:

1. Use of steel wire rope or other support member to support electric downhole heater elements inside continuous tubing for purposes of wellbore heating;
2. Components used to clamp cables to wire rope;
3. Components used to hang-off cable system within a wellhead;
4. Use of dielectric fluid(s) to fill continuous tubing;
5. Ease of retrievability of the heater system of the present invention; and
6. Ability to pull (install) relatively low tensile strength heating elements into coiled tube using the high strength rope.

Advantages of the present invention over the prior art include, without limitation, the following:

1. Ease of installation of the present invention, especially on very long cable systems into tubing (cable supports);
2. Provides requisite clamping force and tensile strength for long or deep heater systems (cable supports);
3. Maintains grip and strength after thermal cycling of the heating element(s);
4. Easier to install the heater system of the present invention into a well than existing prior art methods;
5. Heater elements are protected from wellbore fluids;
6. Use of dielectric fluid(s) for heat transfer, tube integrity monitoring (through pressure monitoring and/or other methods) and improved dielectric performance;
7. Use of dielectric fluid(s) to reduce tension and hanging load of cables and rope (due to buoyancy); and
8. Protection of heater cables and components from well fluids.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A downhole heating apparatus comprising:
one or more electric heating cables;
an elongated support member attached to the heating cables and receiving a mechanical load from the heating cables; and
a cable hang-off configured to vertically suspend the heating cables and the support member, the cable hang-off comprising:
a shell through which the heating cables and the support member are disposed, the shell having a bowl; and
a plurality of slips that cooperate with each other and with the bowl to form a pinching member that grips and suspends the support member.

2. The apparatus of claim 1, wherein the heating cables are mineral insulated cables.

3. The apparatus of claim 1, wherein the support member is a wire rope.

4. The apparatus of claim 3, wherein the wire rope is attached to the heating cables at regular intervals with a cable support clamp.

5. The apparatus of claim 4, wherein the cable support clamp comprises at least one clamp body having a cable cavity for each heating cable and a rope cavity.

6. The apparatus of claim 1, wherein the shell further has a cylindrical mount that receives an end of a length of coiled tubing.

7. The apparatus of claim 6, wherein the heating cables and support member are disposed within the length of coiled tubing when the support member is suspended by the pinching member.

8. The apparatus of claim 7, wherein the coiled tubing is pressure-sealed at its opposite end from the shell, and is filled with a dielectric fluid.

9. The apparatus of claim 1, wherein the slips form a gripping channel in the pinching member, through which the support member is disposed when it is gripped by the pinching member.

10. The apparatus of claim 9, wherein the gripping channel has a non-slide surface formed by projections on a gripping surface of each of the slips.

11. The apparatus of claim 9, wherein the slips further form one or more cable channels in the pinching member, through which the heating cables are disposed when the support member is gripped by the pinching member.

12. A downhole heating apparatus comprising:
one or more electric heating cables;
an elongated support member that receives a mechanical load from the heating cables when the heating cables are suspended vertically by a cable hang-off; and
a plurality of cable support clamps that attach the support member to the heating cables and transfer mechanical loads from the heating cables to the support member, the cable support clamps being attached to the support member and to the heating cables at regular intervals along the length of the support member.

13. The apparatus of claim 12, wherein the heating cables are mineral insulated cables.

14. The apparatus of claim 13, wherein the support member is a wire rope.

15. The apparatus of claim 12, wherein there are three heating cables and each cable support clamp comprises a clamp body having:
a cylindrical center member having an outer surface and a rear surface;
a first wing attached to the center member at the outer surface and having a first cable cavity and a second cable cavity;
a second wing attached to the center member at the outer surface diametrically opposite the first wing, the second wing having a third cable cavity and a rope cavity.

16. The apparatus of claim 15, wherein:
the first and second wings are flush with the rear of the center member;
the first and second wings are about twice the length of the center member in the center member's axial direction; and
the first and second wings each have an arcuate interior surface that conforms to the diameter of the center member and defines a mounting channel between the first wing and the second wing.

17. The apparatus of claim 16, wherein each of the first and second wings further have a groove disposed in an outer surface of the wing.

18. A downhole heating apparatus for a wellbore, the apparatus comprising:
a cable hang-off configured to be installed in a wellbore termination assembly, the cable hang-off having a proximal end and a distal end and comprising:
a cylindrical mount that is disposed in the distal end and receives an end of a length of coiled tubing disposed in the wellbore;
a conical bowl that is disposed in the proximal end and connects with the mount; and
a plurality of slips that cooperate with each other and with the bowl to form a pinching member having a gripping channel and a cable channel;
an electric heating cable disposed in the coiled tubing and in the cable channel; and
an elongated support member attached to the heating cable, disposed in the coiled tubing, and disposed in and gripped by the gripping channel.

19. The apparatus of claim 18, wherein each of the slips is identical and wedge-shaped.

20. The apparatus of claim 19, wherein each slip comprises:
an arcuate outer surface that conforms to the bowl;
a first inner surface adjacent to one end of the outer surface, and a second inner surface adjacent to the other end of the outer surface, the second inner surface being a mirror image of the first inner surface, and each of the inner surfaces comprising a planar portion and an arcuate portion, the first inner surface of one slip cooperating with the second inner surface of an adjacent slip to form a cable channel in the pinching member; and
an arcuate gripping surface that cooperates with the gripping surfaces of the other slips to form a gripping channel in the pinching member.

* * * * *